US006979816B2

(12) United States Patent
Tang et al.

(10) Patent No.: US 6,979,816 B2
(45) Date of Patent: Dec. 27, 2005

(54) MULTI-SOURCE ION FUNNEL

(75) Inventors: Keqi Tang, Richland, WA (US); Mikhail B. Belov, Burlingame, CA (US); Aleksey V. Tolmachev, Richland, WA (US); Harold R. Udseth, Richland, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 4 days.

(21) Appl. No.: 10/400,356

(22) Filed: Mar. 25, 2003

(65) Prior Publication Data

US 2004/0188605 A1 Sep. 30, 2004

(51) Int. Cl.[7] ..... H01J 49/04
(52) U.S. Cl. ..... 250/288; 250/396 R; 250/292
(58) Field of Search ..... 250/288, 396 R, 250/292

(56) References Cited

U.S. PATENT DOCUMENTS 6,501,073 B1 * 12/2002 Mylchreest et al. ..... 250/288
6,583,408 B2 * 6/2003 Smith et al. ..... 250/288
2002/0096631 A1 * 7/2002 Andrien et al.
2003/0168591 A1 * 9/2003 Smith et al.

* cited by examiner

*Primary Examiner*—Nikita Wells
*Assistant Examiner*—Zia R. Hashmi
(74) *Attorney, Agent, or Firm*—Douglas E. McKinley, Jr.

(57) ABSTRACT

A method for introducing ions generated in a region of relatively high pressure into a region of relatively low pressure by providing at least two electrospray ion sources, providing at least two capillary inlets configured to direct ions generated by the electrospray sources into and through each of the capillary inlets, providing at least two sets of primary elements having apertures, each set of elements having a receiving end and an emitting end, the primary sets of elements configured to receive a ions from the capillary inlets at the receiving ends, and providing a secondary set of elements having apertures having a receiving end and an emitting end, the secondary set of elements configured to receive said ions from the emitting end of the primary sets of elements and emit said ions from said emitting end of the secondary set of elements. The method may further include the step of providing at least one jet disturber positioned within at least one of the sets of primary elements, providing a voltage, such as a dc voltage, in the jet disturber, thereby adjusting the transmission of ions through at least one of the sets of primary elements.

34 Claims, 9 Drawing Sheets

MULTI-SOURCE ION FUNNEL

STATEMENT REGARDING FEDERALLY SPONSORED RESEARCH OR DEVELOPMENT

This invention was made with Government support under Contract DE-AC0676RLO1830 awarded by the U.S. Department of Energy. The Government has certain rights in the invention.

CROSS-REFERENCE TO RELATED APPLICATIONS

Not Applicable

BACKGROUND OF THE INVENTION

The growing importance of mass spectrometry for high throughput applications in recent years has stimulated interest in approaches for multiplexing analyses for improving the accuracy of mass spectrometry, and in the development of multiple ion sources. For example, the growing interest in the use of electrospray ionization mass spectrometry (ESI-MS) in proteomic research has virtually created an open-ended demand for high mass measurement accuracy (MMA), where accurate mass measurements for biopolymers can enable their rapid identification and greatly increase the throughput of sample analysis. The results reported by Henry, K. D.; Quinn, J. P.; McLafferty, F. W. *J. Am. Soc. Mass Spectrom.* 1991, 113, 5447–5449; Li, Y. Z.; McIver, R. T.; Hunter, R. L. *Anal. Chem.* 1994, 66, 2077–2083; Kloster, M. B.; Hannis, J. C.; Muddiman, D. C.; Farrell, N. *Biochemistry* 1999, 38, 14731–14737; Zhou, F.; Shui, W.; Lu, Y.; Yang, P.; Guo, Y. *Rapid Commun. Mass Spectrom.* 2002, 16, 505–511; Hannis, J. C.; Muddiman, D. D. *J. Am. Soc. Mass Spectrom.* 2000, 11, 876–883; Flora, J. W.; Hannis, J. C.; Muddiman, D. C. *Anal. Chem.* 2001, 73, 1247–1251; and O'Connor, P. B.; Costello, C. E. *Anal. Chem.* 2000, 72, 5881–5885, among others, have demonstrated that the use of internal calibrants can significantly increase the MMA of MS applications. Traditionally in ESI-MS, internal calibrants have been introduced either simultaneously with the analyte sample solution using a single electrospray, as was shown in Kloster, M. B.; Hannis, J. C.; Muddiman, D. C.; Farrell, N. *Biochemistry* 1999, 38, 14731–14737 or separately using a dual electrospray system as shown in Zhou, F.; Shui, W.; Lu, Y.; Yang, P.; Guo, Y. *Rapid Commun. Mass Spectrom.* 2002, 16, 505–511; Hannis, J. C.; Muddiman, D. D. *J. Am. Soc. Mass Spectrom.* 2000, 11, 876–883; Flora, J. W.; Hannis, J. C.; Muddiman, D. C. *Anal. Chem.* 2001, 73, 1247–1251. In the dual electrospray systems shown in the references given above, the calibrant and the analyte are alternatively introduced through a single capillary, by mechanically switching between the two ion sources. These systems thus suffer from drawbacks associated with mechanical switching, such as relatively slow changes between analyte and calibrant, and difficulties in controlling ion sampling and transmission into the mass spectrometer. Alternatively, with FTICR or other ion-trapping instruments, calibrant ions can be introduced from a second ion source that functions in the vacuum of the MS as described in Winger, B. E.; Castoro, J. A.; Tutko, D.; Campana, J. E. Proceedings of the 44th ASMS Conference, Portland, Oreg., May 1996. Unfortunately, the quality of the calibration obtained from such an arrangement will generally provide lower MMA, since the ions will generally be trapped at somewhat different ion energies and spatially occupy somewhat different regions of the ion trap, which result in "shifts" of mass measurements. Dual electrospray may be operated in the continuous mode and sampled simultaneously into the mass spectrometer as described in Zhou, F.; Shui, W.; Lu, Y.; Yang, P.; Guo, Y. *Rapid Commun. Mass Spectrom.* 2002, 16, 505–511. They can also be operated in a sequential mode using mechanical switching devices as described in Hannis, J. C.; Muddiman, D. D. *J. Am. Soc. Mass Spectrom.* 2000, 11, 876–883; Flora, J. W.; Hannis, J. C.; Muddiman, D. C. *Anal. Chem.* 2001, 73, 1247–1251.

Several problems associated with the introduction and use of internal calibrants continue to limit their application. As was reported in Kloster, M. B.; Hannis, J. C.; Muddiman, D. C.; Farrell, N. *Biochemistry* 1999, 38, 14731–14737, when both analyte sample and calibrant are introduced simultaneously into the single electrospray, the ion competition/suppression in the ESI process can significantly reduce sensitivity to the analyte. As was reported in Zhou, F.; Shui, W.; Lu, Y.; Yang, P.; Guo, Y. *Rapid Commun. Mass Spectrom.* 2002, 16, 505–511, when dual electrosprays of analyte and calibrant are operated continuously, the interaction of electrosprays in the ESI interface can also significantly reduce MS sampling efficiency. In addition, as reported in Hannis, J. C.; Muddiman, D. D. *J. Am. Soc. Mass Spectrom.* 2000, 11, 876–883; Flora, J. W.; Hannis, J. C.; Muddiman, D. C. *Anal. Chem.* 2001, 73, 1247–1251, when dual electrosprays are operated in the sequential mode, the limited speed of mechanical switching may significantly decrease the overall MS duty cycle.

Of particular importance for ion trap and FTICR instruments is that calibrant ions contribute to the space charge effect in the MS analyzer and affect the mass measurement accuracy. The introduction of calibrant ions from a different ion source (or at a different time) can also cause the spatial distribution of ions to differ from analyte ions and lead to measurement errors. In addition, the calibrant ions can constitute a significant fraction of the space charge capacity of the ion traps and, thus, constrain the achievable dynamic range of the measurements. These problems become especially pronounced when ESIMS is used for the analysis of a complex biological sample for which extremely high sensitivity and broad dynamic range are required. In designs that provide for a constant rate of calibrant ion introduction (e.g., as for reported dual electrospray designs) and when relative analyte concentration varies widely (e.g., in proteomics), calibrant peak abundances may range from dominant in some spectra to negligible in others, which limits both achievable MMA and dynamic range.

Thus, there remains a need for methods and apparatus that address these issues, and allow effective control of ion transmission into the mass spectrometer. Optimally, such methods and apparatus would allow both static and dynamic control of ion transmission, and would allows modulation of calibrant ion peak intensities while maintaining optimum ion transmission for analyte ions and, thus, provide the basis for simultaneously achieving optimum sensitivity, dynamic range, and MMA.

BRIEF SUMMARY OF THE INVENTION

Accordingly, it is an object of the present invention to provide a method and apparatus for introducing ions from multiple sources from a region at relatively high pressure to a region at relatively low pressure. It is a further object of the present invention to provide a method and apparatus for introducing ions from multiple sources from a region at relatively high pressure to a region at relatively low pressure in a manner that allows for precise control of the quantity of ions introduced each source. It is yet a further object of the present invention to provide a method and apparatus for introducing ions from multiple sources from a region at relatively high pressure to a region at relatively low pressure in a manner that allows the user to control the quantity of ions introduced from each source with a highly responsive electronic system. It is yet a further object of the present invention to provide a method and apparatus for introducing ions from multiple sources from a region at relatively high pressure to a region at relatively low pressure in a manner that allows the user to rapidly switch between each source of ions. It is a further object of the present invention to provide a method and apparatus for introducing analyte ions and calibrant ions generated from separate sources in a region at relatively high pressure to a region at relatively low pressure in a manner that allows the user to precisely control the amount of analyte ions and calibrant ions introduced at any given time, and to rapidly change the amount of analyte ions and calibrant ions introduced at any given time.

These and other objects of the present invention are accomplished by providing a multi-source ion funnel. The basic concept of an ion funnel was described in detail in U.S. Pat. No. 6,107,628, entitled "Method And Apparatus For Directing Ions And Other Charged Particles Generated At Near Atmospheric Pressures Into A Region Under Vacuum," the entire contents of which are hereby incorporated herein by this reference. Briefly, as described in U.S. Pat. No. 6,107,628, an ion funnel is a plurality of elements, each having progressively larger apertures wherein the apertures, form an ion funnel having an entry at the largest aperture and an exit at the smallest aperture. An RF voltage is applied to each of the elements such that the RF voltage applied to each element is out of phase with the RF voltage applied to the adjacent element(s). Typically, a mechanical means, such as a fan, a vacuum, or some combination thereof, is also provided to assist in directing charged particles through the ion funnel. Further, an electrical means, such as a DC potential gradient across the plurality of elements is also provided to assist in directing charged particles through the ion funnel. While elements and the apertures used in the ion funnel may be any shape, typically they are selected as circular.

It is important to note that the while the present invention utilizes the concept of the ion funnel taught in U.S. Pat. No. 6,107,628, it also expands and greatly extends the utility of those concepts, and does so in a manner that relieves the invention of many of the limitations of U.S. Pat. No. 6,107,628. Thus, while the description herein relies on the disclosure of U.S. Pat. No. 6,107,628 to teach the rudimentary concepts of an ion funnel, the present invention should in no way be viewed as limited by the disclosure of U.S. Pat. No. 6,107,628. For example, while U.S. Pat. No. 6,107,628 describes the elements as having progressively larger elements, for purposes of this disclosure, such is not necessarily required. Further, with respect to the "sets of primary elements" described in greater detail below, it is not necessary that these elements even consist of a series of elements having apertures. As an alternative, a multipole arrangement, as is commonly used to guide ions in mass spectrometer instruments, may also be utilized as the "sets of primary elements." The term "ion funnel" as used herein should therefore be understood to encompass sets of elements that may be of the same size, or which may be of increasing size, or which may be of varying size. When describing the sets of primary elements, the term "ion funnel" as used herein should further be understood to encompass multipole arrangements.

The present invention allows the introduction of ions from multiple sources by providing multiple ion funnels, termed herein as "sets of primary elements" one for each source of ions. These sets of primary elements in turn feed into another ion funnel, termed herein as a "secondary set of elements." In this manner, ions from multiple ion sources can be readily passed from a region of relatively high pressure at the entrance of the sets of primary elements, to a region of relatively low pressure at the exit of the set of secondary elements. As ions are passed from the primary set of elements to the secondary set of elements, they are combined into a single pathway. The combination of the primary sets of elements and the secondary set of elements is collectively referred to herein as a "multi-source ion funnel."

By way of illustrative example, and not meant to be limiting, the simplest form of a multi-source ion funnel is shown in FIG. 1. As shown in the figure, the multi-source ion funnel 1 of this illustrative example has two sets of primary elements 2. Ions pass through the apertures formed by these primary elements 2 and are in turn delivered to the entrance of a secondary set of elements 3. Those skilled in the art will readily recognize that while this illustrative example shows only two sets of primary elements, it is possible to extend the concept to have any number of primary sets of elements. Also, as described above, the primary elements 2 may take the form of a multipole arrangement as shown in FIG. 2. In either case, the present invention should in no way be limited to methods and apparatus having only two sets of primary elements.

The utility of the multi-source ion funnel is readily apparent when one considers the challenges confronting electrospray ionization mass spectrometry (ESI-MS). Ions generated by an electrospray are typically generated in a region external to the mass spectrometer at about ambient, or atmospheric, pressures. The ions are then passed into a region of relatively lower pressure within the interior of the instrument through a capillary. By positioning a multi-source ion funnel in the interior of the instrument and adjacent to at the entrance, the present invention allows multiple electrosprays to feed ions into multiple capillaries which are then combined into a single ion stream for detection and analysis downstream in the interior of the instrument.

A further advantage of the present invention is derived from the use of jet disturbers in one or several of the primary sets of elements. The use of a jet disturber in connection with an ion funnel was first described in U.S. patent application Ser. No. 09/860,721, filed May 18, 2001, and entitled "Ionization Source Utilizing A Jet Disturber In Combination With An Ion Funnel And Method Of Operation," the entire contents of which are hereby incorporated herein by this reference. As described in U.S. patent application Ser. No. 09/860,721, a "jet disturber" is simply a physical barrier placed inside the apertures of an ion funnel. Referring again to FIG. 1, a jet disturber 4 is shown within the primary elements 2. Typically, a jet disturber is provided as a metal disk. As described in U.S. patent application Ser. No. 09/860,721, the placement of a jet disturber in this manner will greatly enhance ion conductance.

As with the description of the ion funnel contained in U.S. Pat. No. 6,107,628, It is important to note that the while the present invention utilizes the concept of the jet disturber taught in U.S. patent application Ser. No. 09/860,721, it also expands and greatly extends the utility of those concepts, and does so in a manner that relieves the invention of many of the limitations of U.S. patent application Ser. No. 09/860,721. Thus, while the description herein relies on the disclosure of U.S. patent application Ser. No. 09/860,721 to teach the rudimentary concepts of an jet disturber, the present invention should in no way be viewed as limited by the disclosure of U.S. patent application Ser. No. 09/860,721. For example, while U.S. patent application Ser. No. 09/860,721 describes the jet disturber as preferably being used in conjunction with a multi-capillary inlet, for purposes of this disclosure, such is not necessarily required.

One aspect by which the present invention expands and extends the utility of the jet disturber is through the use of voltages applied to the jet disturber. In contrast to the enhanced ion conductance generally associated with the use of a jet disturber as taught in U.S. patent application Ser. No. 09/860,721, the use of an applied voltage can have the opposite effect. For example, a suitable dc voltage applied to the jet disturber can attract ions passing through the primary set of elements, thereby preventing them from passing. Alternatively, another suitable dc voltage applied to the jet disturber can repel ions passing through the primary set of elements, also preventing them from passing. In between these two extremes, the passage of ions can thus be easily controlled by the application of voltage to the jet disturber. As will be recognized by those having skill in the art, the voltage applied to the jet disturber can be easily controlled with a suitable power supply, and may further be rapidly changed as desired by the user. Thus, the present invention is further enhanced by the use of jet disturbers connected to a power supply in one or more of the primary sets of elements, as this allows the user to readily adjust the passage of ions through that primary set of elements.

The present invention is thus a multi-source ion funnel for introducing ions from a region at relatively high pressures to a region at relatively low pressures having at least two sets of primary elements having apertures, each set of elements having a receiving end and an emitting end, the first sets of elements configured to receive a ions from at least two separate ion sources at the receiving ends, and a secondary set of elements having elements having a receiving end and an emitting end, the secondary set of elements configured to receive said ions from the emitting end of said primary sets of elements. The multi-source ion funnel may further utilize at least one jet disturber positioned within the interior of at least one of said sets of primary elements, and may include a means for providing a voltage to the jet disturber.

As utilized in a mass spectrometer, the present invention includes at least two electrospray ion sources, at least two capillary inlets, and a mutli-source ion funnel, wherein each of the electrospray ion sources is configured to direct ions generated by the electrospray sources into and through each of the capillary inlets, and the capillary inlets are further configured to direct the ions into the receiving end of the sets of primary elements.

The present invention is thus also a method for introducing ions generated in a region of relatively high pressure into a region of relatively low pressure by providing at least two electrospray ion sources, providing at least two capillary inlets configured to direct ions generated by the electrospray sources into and through each of the capillary inlets, providing at least two sets of primary elements having apertures, each set of elements having a receiving end and an emitting end, the primary sets of elements configured to receive a ions from the capillary inlets at the receiving ends, and providing a secondary set of elements having apertures having a receiving end and an emitting end, the secondary set of elements configured to receive said ions from the emitting end of the primary sets of elements and emit said ions from said emitting end of the secondary set of elements. The method may further include the step of providing at least one jet disturber positioned within at least one of the sets of primary elements, providing a voltage, such as a dc voltage, in the jet disturber, thereby adjusting the transmission of ions through at least one of the sets of primary elements. The step of adjusting the transmission of ions may prevent the transmission of ions, and the applied voltage may be applied intermittently, for example as a square wave form, thereby providing intermittent disruption of the ions.

A preferred embodiment of the present invention utilizes a luti-source ion funnel in an ESI-MS instrument. A jet disturber is provided within each of two sets of primary elements to control the transmission of calibrant and analyte ions. The transmission of calibrant and analyte ions may be controlled in either a dynamic or in a static mode, Utilized in this manner, the present invention provides a particularly useful method for introducing calibrant ions and analyte ions into a mass spectrometer. As the voltage is alternated between the jet disturbers, the disruption of the transmission of calibrant ions and analyte ions is likewise alternating through the sets of primary elements.

DETAILED DESCRIPTION OF THE INVENTION

Figure 1:
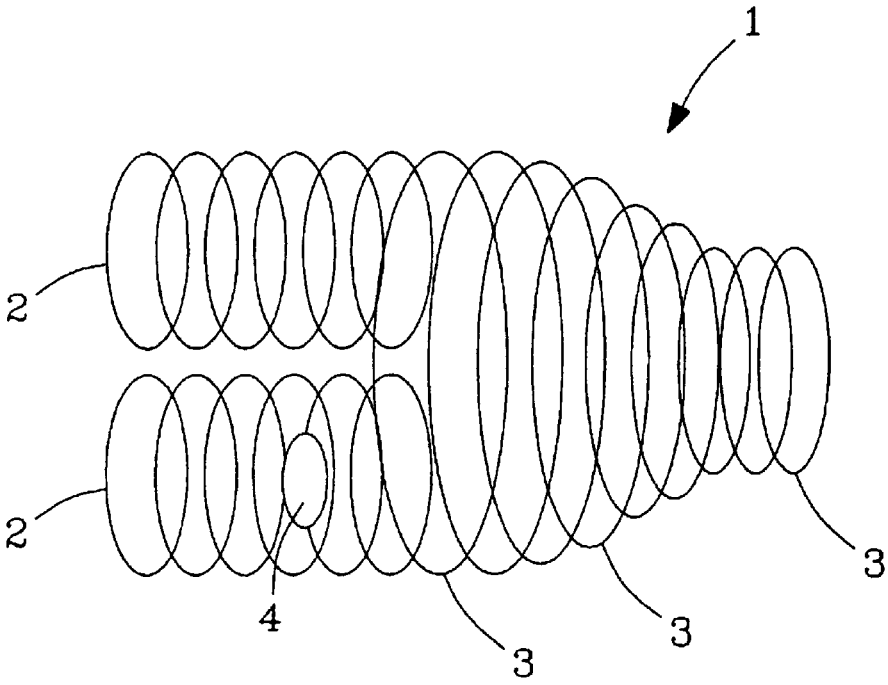
FIG. 1 is a schematic drawing showing the basic configuration of multi-source ion funnel of the present invention.

A preferred embodiment, entailing both the apparatus and allowing the practice of the method of the present invention, was fabricated as described below. A series of experiments, also described below, was then conducted to demonstrate the advantages offered by the present invention. While a preferred embodiment of the present invention is thus shown and described in sufficient detail to allow an exact replication of the apparatus and method, it will be apparent to those skilled in the art that the invention should in no way be viewed as limited to such an exact replication, and many changes and modifications may be made without departing from the spirit and scope of the invention in its broader aspects.

For example, while the specific dimensions of the multi-source ion funnel are described in some detail, such dimensions should be considered merely illustrative of the specific instrument actually constructed to demonstrate the present invention. Departures from the given dimensions which nevertheless utilize the basic concept of a multi-source ion funnel should certainly be considered as falling within the scope of the appended claims. Further, while the instrument described below utilized two sets of primary elements in the ion funnel, as described in the summary of the invention, the present invention should be understood as contemplating more than two sets of primary elements, thereby allowing more than two ion sources to be fed into the instrument. Further, as noted in the summary of the invention above, while a series of rings was utilized as the sets of primary elements in the preferred embodiment described below, mulitpole arrangements could be substituted for these rings without departing from the spirit and scope of the present invention. Also, while the preferred embodiment of the present invention described below was demonstrated in a electrospray ionization mass spectrometer which is described in great detail, it should be understood that the present invention contemplates ion sources other than electrospray, and ion detection and analysis techniques including mass spectrometry in all of its forms, as well as detection and analysis techniques commonly used to detect and analyze ions other than mass spectrometry. Additionally, while the specific operating parameters for experiments are described in great detail, including the voltages used in the instrument, and the specific analyte and calibrant ions, those having skill in the art will recognize that the operating parameters may readily be altered without departing from the essence of the invention, and that the technique of the present invention is equally applicable to all calibrant and analyte ions conventionally analyzed and detected. The present invention should be understood as encompassing all such variations in operating parameters and the appended claims are therefore intended to cover all such changes and modifications as fall within the true spirit and scope of the invention.

Figure 3A:
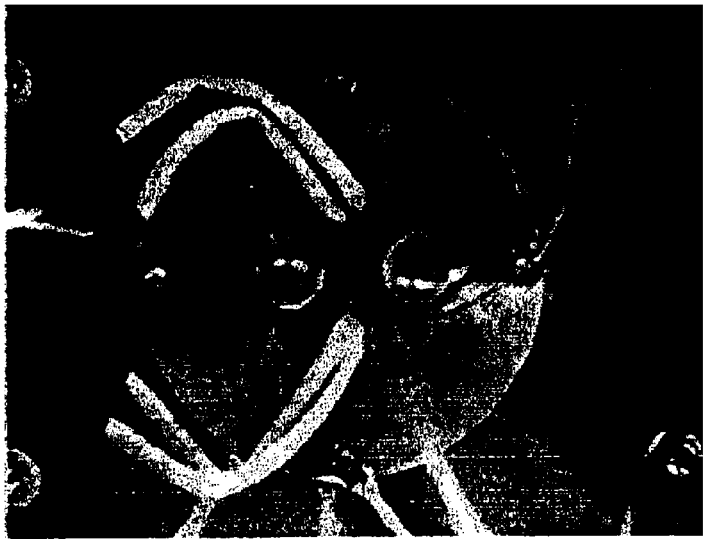
FIG. 3. Shows a dual-channel API interface on the Agilent MSD1100 single quadrupole mass spectrometer with the (a) dual heated capillaries and (b) dual-channel ion funnel of different diameters with a jet disturber installed in the smaller diameter channel.

The experimental evaluation of the present invention was performed using a single quadrupole mass spectrometer (Agilent MSD1100). As shown in FIG. 3, the standard API interface of the mass spectrometer was replaced with an interface consisting of a dual electrospray ion source, a dual heated capillary inlet and a multi-source ion funnel. As noted above, the multi-source ion funnel fabricated for this experiment as configured to receive ions from two sources, and hereinafter this particular multi-source ion funnel is referred to as a dual-channel ion funnel. For this experiment, the dual-channel ion funnel was fabricated with each channel having different diameters, and a metal jet disrupter installed in the smaller inlet channel of the ion funnel.

The dual electrospray emitters were mounted on an X-Y translation stage, allowing fine adjustment of their positions with respect to the dual heated capillary inlet. Each electrospray emitter was connected to a microsyringe through a metal LC union. A syringe pump, pushing two microsyringes simultaneously, was used for sample infusion. A high-voltage DC power supply connected to the LC unions was used to create the DC potential necessary for stable electrospray operation. The dual electrospray emitters, spaced 14 mm apart and positioned between 3 and 5 mm from the heated capillary inlet, were used to introduce different sample mixtures into the MS system. The initial design used dual heated capillaries spaced at the same distance as the dual electrospray emitters and with two 430-Ìm-i.d. metal capillaries silver-soldered into a metal block as shown in FIG. 3*a*. Two cartridge heaters were used to heat the capillary block, and the temperature of the heated capillary was monitored by thermocouples and regulated using a closed-loop temperature control unit (Omega CN9000A). The exits of the capillaries were aligned with the inlet of the dual channel ion funnel.

Figure 3B:
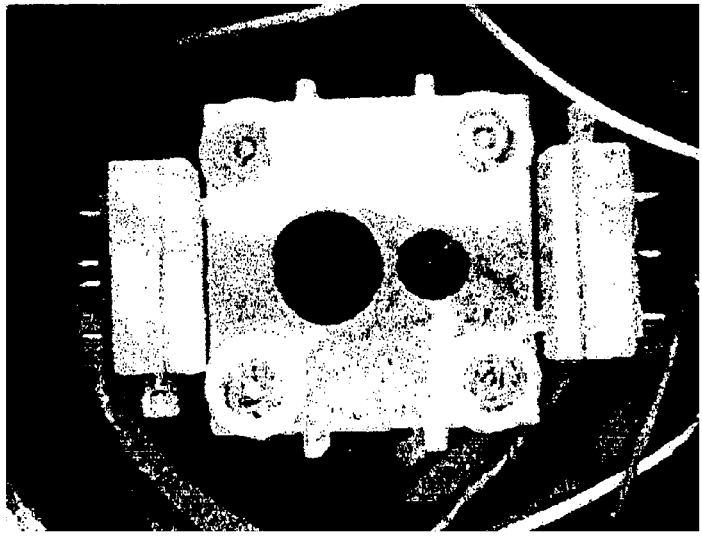
Figure 3C:
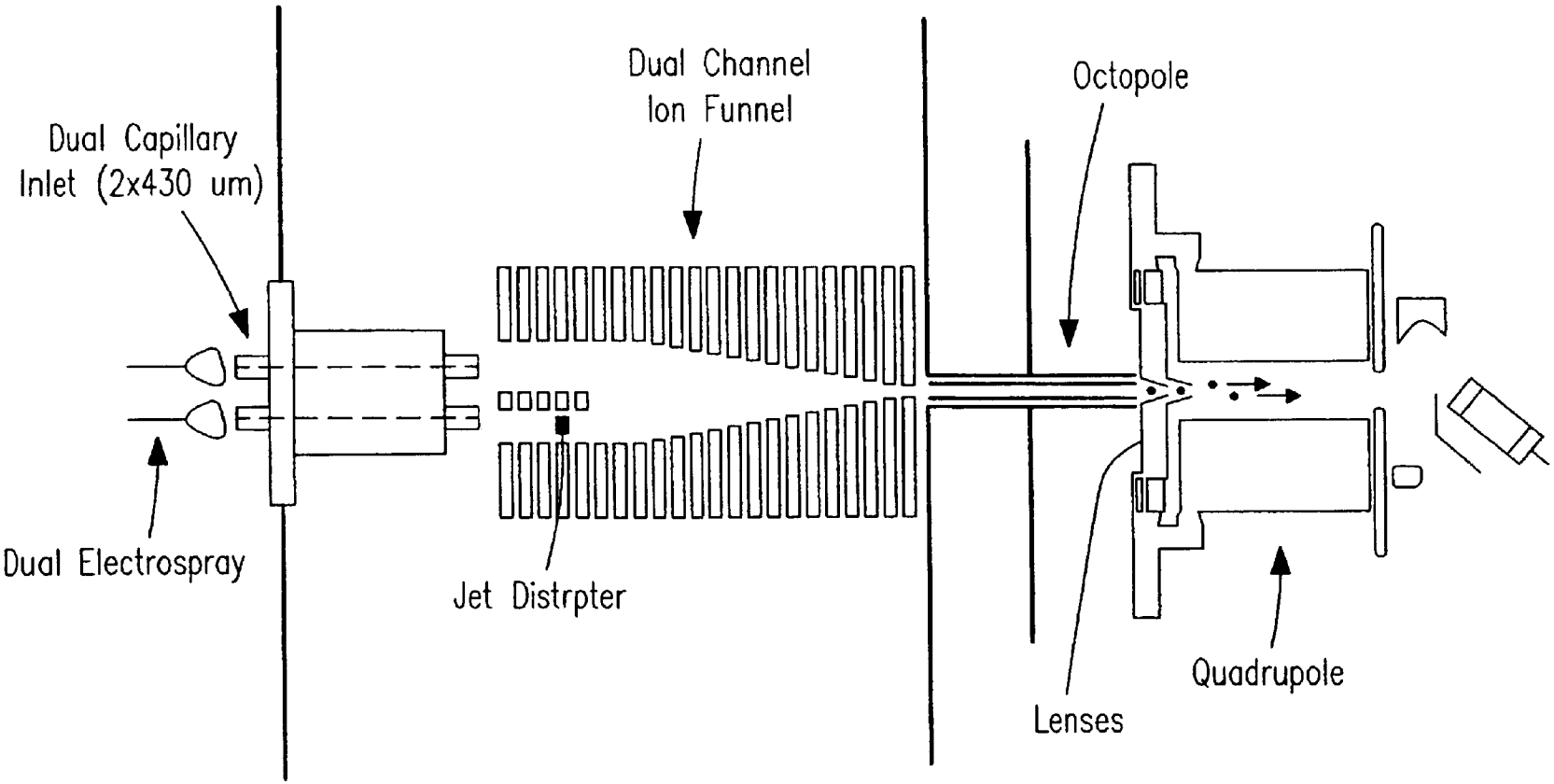

The initial section of the standard single channel ion funnel, measuring 22 mm in length, was replaced with the dual-channel funnel plates (FIG. 3). As shown in FIG. 3*b*, these channels have fixed but different internal diameters, measured at 14.3 and 9.1 mm respectively, that are constant over their length. An electrically isolated jet disturber, 2 mm in diameter, was installed in the small channel of the ion funnel at a distance of 20 mm from the funnel inlet. The metal disk was soldered onto a dual channel ion funnel electrode and centered in the small diameter hole by two thin wires. The contact metal tabs on both sides of the funnel plate were removed, and a separate power supply was used to independently control its voltage. To maintain the regular RF phase alternation on the two neighboring ion funnel plates to the DC-only jet disturber electrode (180° on each neighboring plate), a pair of regular ion funnel plates was first removed at the location for the jet disturber electrode and then replaced with two Teflon insulation sheets. This results in a total of five Teflon sheets and increases the spacing from 1 mm to 3 mm between the two regular ion funnel electrodes. The middle Teflon sheet was then replaced by the jet disrupter plate, resulting in a 1.5-mm spacing between it and each regular neighboring ion funnel plate on both sides of the jet disturber plate. The large diameter main channel was tuned for optimum ion transmission in all the experiments. Ion transmission in the small channel was modulated by the bias voltage applied to the jet disturber. The two channels eventually converge into a single channel, and the ions from both channels were mixed and transmitted together into the mass analyzer.

The Agilent ESI tuning mix, described in U.S. Pat. No. 5,872,357, issued Feb. 16, 1999 and entitled "Mass spectrometry calibration using homogeneously substituted fluorinated triazatriphosphorines" which generates singly charged molecular ions at m/z 118, 322, 622, 922, 1522, and 2122, and reserpine at 1 ng/uL in 50:50 methanol/water +1% acetic acid, which produces singly charged molecular ions at m/z of 609.2, were used as sample solutions for the interface performance evaluation. The concentrations for each component in Agilent tuning mix were 1.17 ng/uL for ion at m/z 118, 9.19 ng/uL for ion at m/z 322, 9.32 ng/uL for ion at m/z 622, 18.42 ng/uL for ion at m/z 922, 22.81 ng/uL for ion at m/z 1522, and 46.66 ng/uL for ion at m/z 2122.16 The solvent used for the Agilent tuning mix was 95:5 acetonitrile/water +2 mM TFA. The electrospray was operated at a flow rate of 2 uL/min. The temperature of the dual heated capillary inlet was fixed at 150° C. A DC bias at 220 V was applied to the dual heated capillary block. The RF frequency and the amplitude applied to the ion funnel were 500 kHz and 70 Vp-p, respectively. The DC biases on the first ion funnel plate and the last ion funnel plate were 200 and 35 V, respectively, which resulted in an axial DC field of 16 V/cm in the ion funnel. A variable DC bias and a square waveform voltage with variable frequency and duty cycle were applied to the jet disturber for both static and dynamic modulations of the ion transmission through the ion funnel. Because of the increased gas throughput of the dual capillary inlet, an additional mechanical pump (Edwards E1M18) was used to pump the ion funnel chamber. The ion funnel pressure was measured at 1.33 Torr, and the analyzer chamber pressure, at $4.5\times10^{-6}$ Torr. The mass spectrometer was operated in the positive ESI mode.

Figure 2:
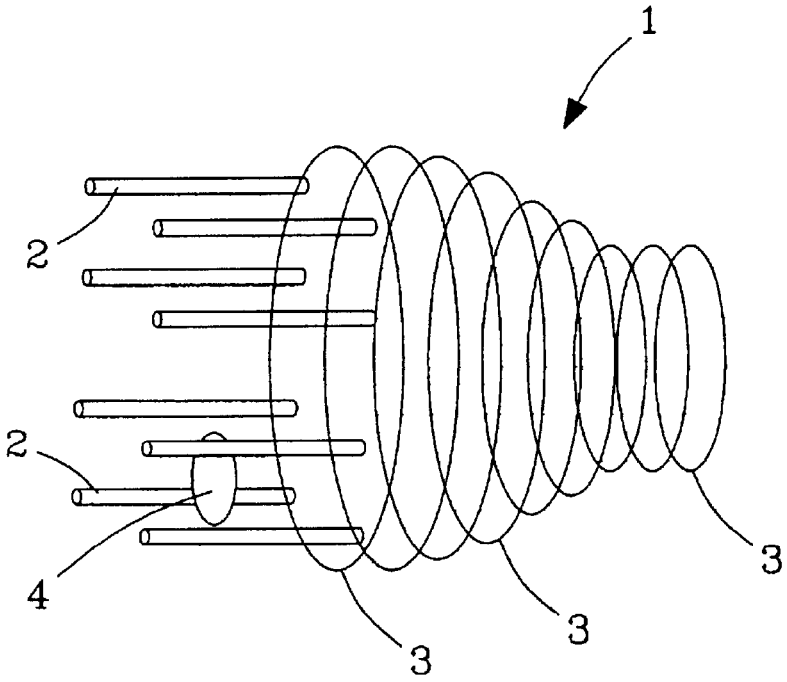
FIG. 2 is a schematic drawing showing the basic configuration of multi-source ion funnel of the present invention when utilizing mulitpoles in the sets of primary elements.
Figure 4A:
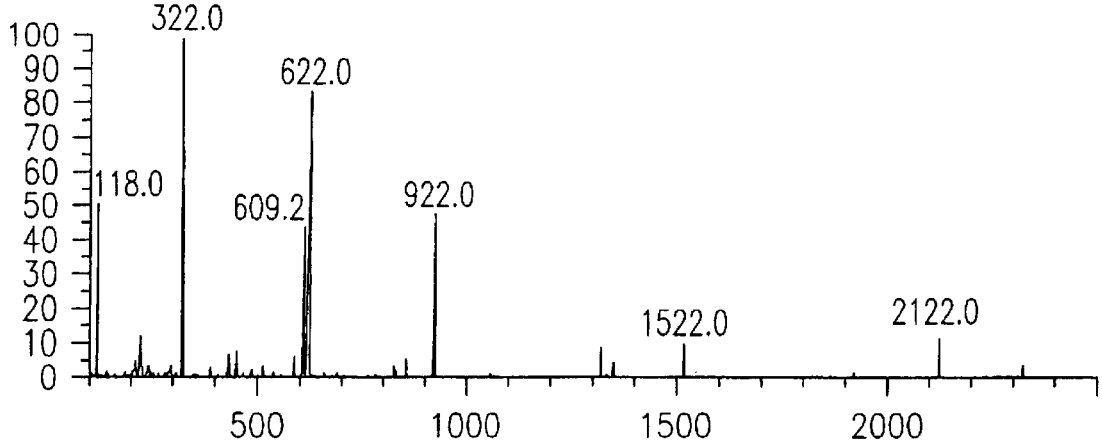
FIG. 4 shows a full scan mass spectrum at (a) jet disturber voltage of 165 V for optimum ion transmission, (b) jet disturber voltage of 110 V for maximum suppression of ion transmission, and (c) ion transmission modulation for reserpine ions at m/z609, and at different jet disturber DC bias voltages. Agilent ESI tuning mix was used for the main ion funnel channel electrospray, and reserpine solution was used for the jet disturber channel electrospray. Ion funnel voltage settings: DC+, 201.9 V; DC−, 36.4 V; RF, 70 $V_{p\text{-}p}$, 500 kHz; $DC_{cap}$, 218.8 V; temperature, 150° C.; ESI infusion rate, $2_{\mu}$L/min.
Figure 4B:
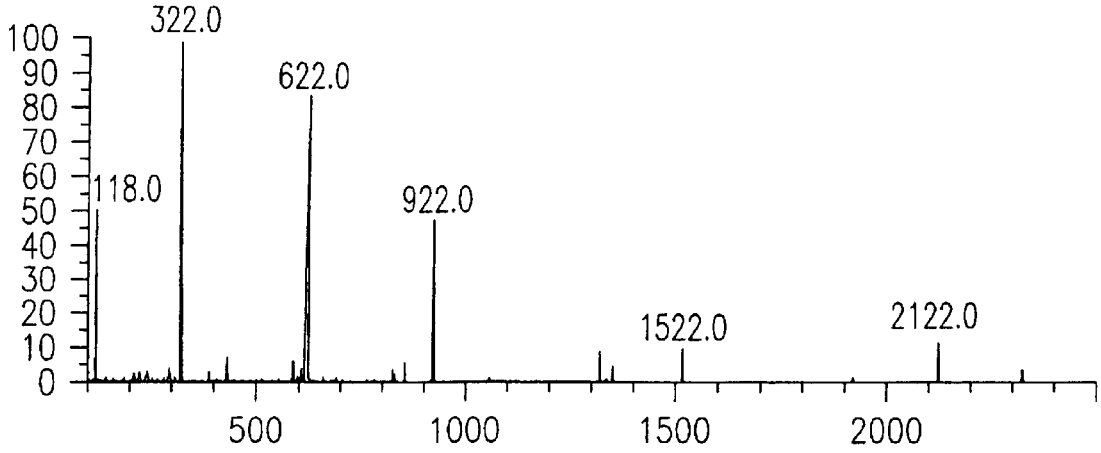
Figure 4C:
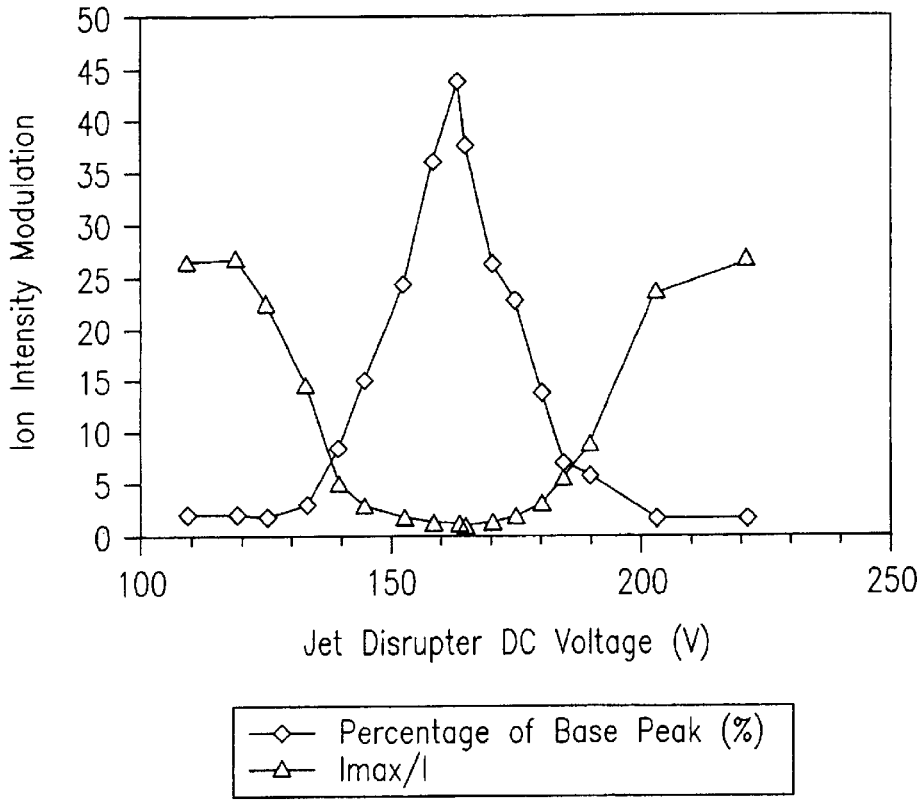

Strong space charge effects in electrosprays limit the speed or utility of ion transmission modulation at atmospheric pressure, and mechanical switching of dual electrospray is relatively slow for ion inlet manipulation. The capability for ion transmission modulation through the dual channel ESI interface was first investigated experimentally by changing the jet disturber DC bias. The Agilent ESI tuning mix was introduced to the main channel electrospray. The reserpine solution was used for the jet disturber channel electrospray inlet. Mass spectra at both the optimum jet disturber voltage for maximum ion transmission and the voltage corresponding to maximum suppression of ion transmission are shown in FIGS. 4*a* and *b*. At the optimum jet disturber voltage of 165 V, the reserpine ion intensity m/z 609 accounted for approximately 40% of the base peak (FIG. 4*a*). The reserpine ions were almost completely suppressed when the jet disrupter voltage was at 110 V (FIG. 4*b*), demonstrating the effective electric modulation of ion transmission through the jet disturber channel of the ion funnel. Once effective ion transmission modulation was observed, the ion transmission through the jet disturber channel was further characterized. FIG. 4*c* shows variations of the base peak percentage of reserpine ion and the ratio of maximum reserpine ion intensity to the reserpine ion intensity, $I_{max}/I$, at different jet disturber voltages. As shown in FIG. 2*c,* the ion transmission reaches a maximum at a jet disturber voltage of 165 V and decreases rapidly when the voltage either increases or decreases. At approximately 40 V difference from the optimum ion transmission voltage, maximum ion transmission suppression was observed. Specifically, the base peak percentage of the ion intensity decreased from 45% to approximately 2% ($I_{max}/I$ increases from 1 to ~26).

The DC potential applied to each ion funnel plate was derived from a linear resistor chain, resulting in a constant DC gradient across the ion funnel. The DC potential at each funnel plate can be easily calculated using $$V_p=DC^+-(L_p/L)(DC^+-DC^-)$$

where Vp is the DC potential on the funnel plate measured at distance $L_p$ from the first ion funnel plate, L is the total length of the ion funnel (100 mm), and $DC^+$ and $DC^-$ are the DC potentials at the first and last ion funnel plates, respectively. From the DC potential settings (FIG. 4), the DC potential of the ion funnel plate next to the jet disrupter, 20 mm from the first ion funnel plate, was calculated to be 168.8 V. This indicates that the ion funnel provides optimum ion transmission when the jet disturber voltage was approximately equal to the DC potential at its neighboring ion funnel plate. This conclusion was further confirmed by theoretical simulations (discussed below) in which the potential difference between the jet disturber and the neighboring ion funnel plate was defined as the DC offset of the jet disturber.

Figure 5A:
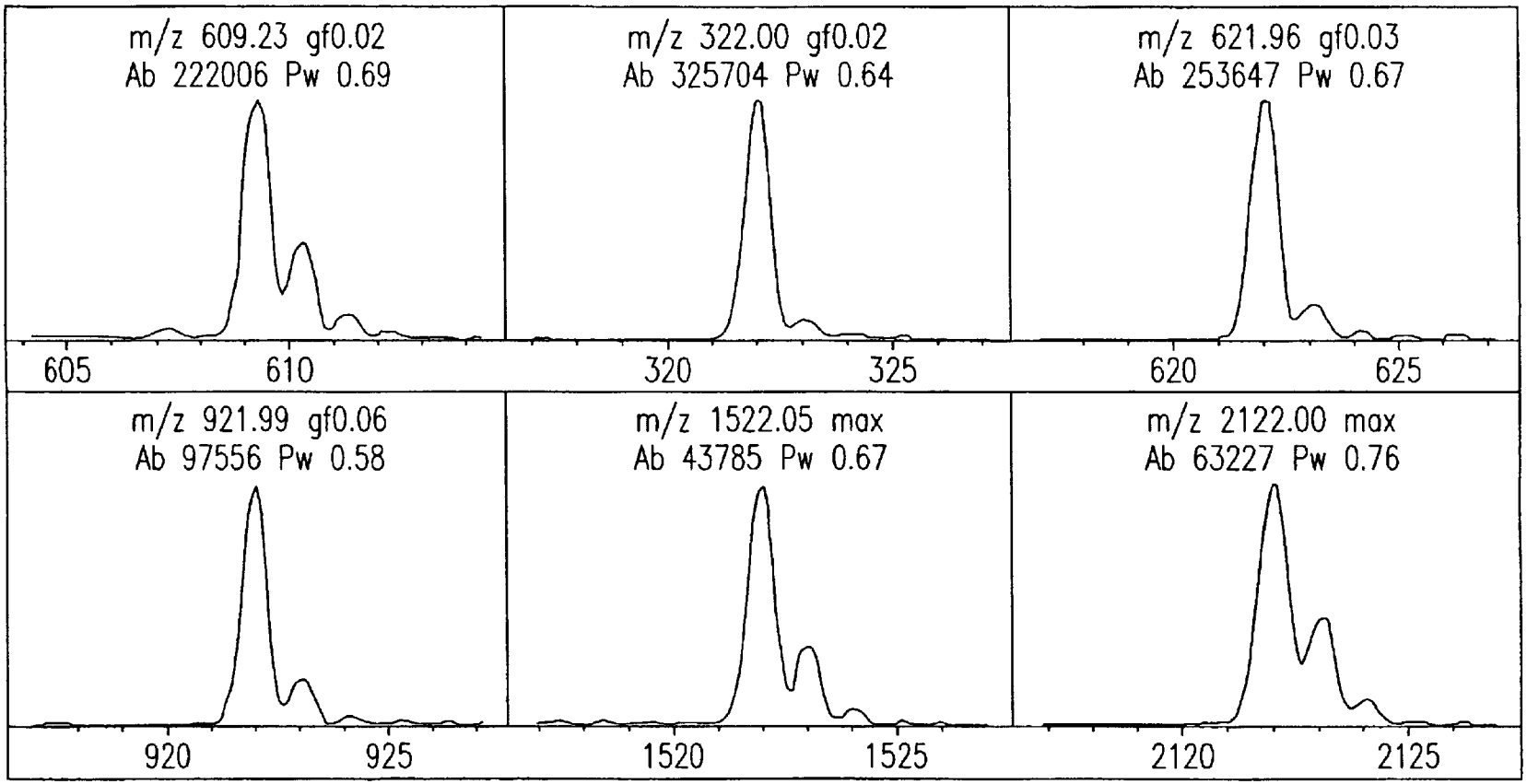
FIG. 5. is a comparison of sensitivity for different m/z ions at different jet disturber DC voltages: (a) 165 and (b) 115 V using the same experimental conditions as specified in FIG. 6.
Figure 5B:
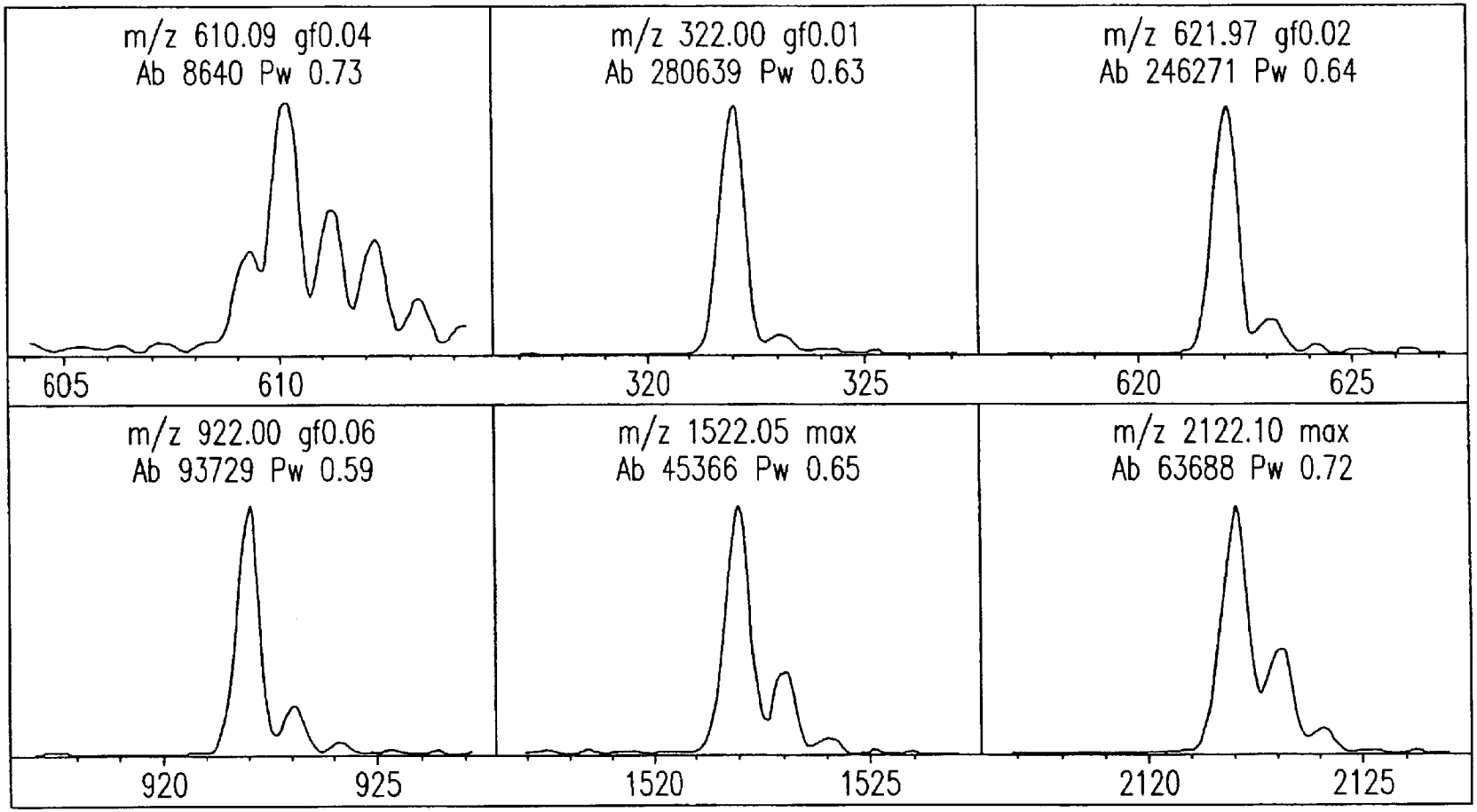

Because the jet disturber was mounted in a dual-inlet funnel electrode and the spacing of RF ion funnel plates at the jet disturber location increased significantly from 1 to 3 mm, it was important to determine whether the ion transmission modulation in the jet disrupter channel also affected ion transmission in the main channel of the ion funnel. FIG. 5 shows the mass spectral regions for each ion species at both maximum ion transmission (FIG. 5*a*) and ion suppression (FIG. 5*b*) jet disturber voltages. The ion intensities for each corresponding peak, shown in spectra FIG. 5 clearly indicate that the main channel ion transmission is essentially constant, but the intensity of reserpine (m/z ) 609.2) ions in the jet disturber channel is changed by a factor of at least 25 between optimum ion transmission jet disturber voltage, FIG. 5*a,* and maximum ion suppression jet disturber voltage, FIG. 5*b.*

The shift of the reserpine peak in FIG. 5*b* is due to the chemical noise from the main channel electrospray. As verified experimentally, no mass shift was observed for the reserpine peak at the maximum ion suppression jet disturber voltage if the main channel electrospray of the Agilent ESI tuning mix was turned off. This implies an even better ion transmission modulation efficiency in the jet disturber channel. FIG. 5 clearly indicates negligible "cross talk" in ion transmission between the dual channels of the ion funnel. As discussed in the summary of the invention, a second jet disturber can be installed in the main channel of the ion funnel if independent modulations of ion transmission in both channels is desired.

To ensure that effective ion transmission modulation can be achieved over a broad m/z range, the dual channel interface was further evaluated by switching the sample solutions. As shown in both FIG. 6 and Table 1, similar ion transmission modulation efficiency was achieved for all peaks in the Agilent ESI tuning mix. The data listed in Table 1 further indicates that ion intensity modulation by a factor of 28 to 35 for all the m/z ions can be obtained when the jet disturber voltage is at optimum ion transmission and maximum ion suppression conditions, respectively.

TABLE 1

Effective Ion Transmission Modulation and Optimum Jet Disturber Voltages for Different m/z Ions

| m/Z | $I_{max}/I$ | optimum $V_{jd}$ | m/z | $I_{max}/I$ | optimum $V_{jd}$ (V) |
|---|---|---|---|---|---|
| 322 | 30 | 165.9 | 1522 | 35.2 | 158.3 |
| 622 | 29.5 | 165.9 | 2122 | 29.7 | 158.3 |
| 922 | 28.9 | 165.9 | 609b | 1.1 b | |

(Ion funnel voltage settings: $DC^+$, 201.5 V; $DC^-$, 35 V; RF, 70 $V_{p-p}$, 500 KHz; $DC_{cap}$, 218.9 V; temp, 150° C.; main channel electrospray, reserpine (1 ng/uL); jet disturber channel electrospray: Agilent ESI tuning mix; infusion rate: 2 uL/min. b Indicating the constant ion transmission for reserpine ions in the main channel of the ion funnel during the ion transmission modulation in the jet disturber ion channel of the ion funnel.)

Figure 6:
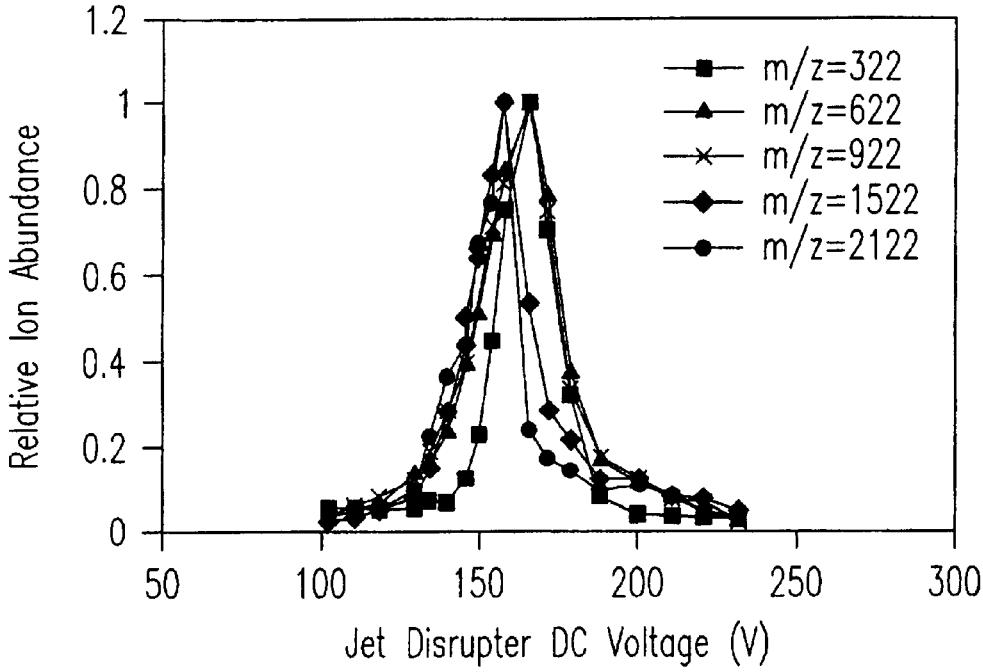
FIG. 6 is a graph showing ion transmission through the jet disturber channel at different DC bias voltages for different m/z ions from Agilent ESI tuning mix. The ion funnel voltage settings were: $DC^{+}$, 201.5 V; $DC^{-}$, 35 V; RF, 70 $V_{p\text{-}p}$, 500 kHz; $DC_{cap}$, 218.9 V. Temperature, 150° C.; ESI Analyte ion funnel channel, reserpine (1 ng/$_{\mu}$L), Calibrant jet disrupter) ion funnel channel, Agilent ESI tuning mix; infusion rate, $2_{\mu}$L/min.

The ion transmission in the main ion funnel channel for the reserpine ion still remains independent of the ion modulations in the other channel. The slight shift of the optimum ion transmission conditions to lower jet disturber voltages for higher m/z ions, as shown in FIG. 6, may be related to the higher inertia of the ions in the gas flow.

Figure 7:
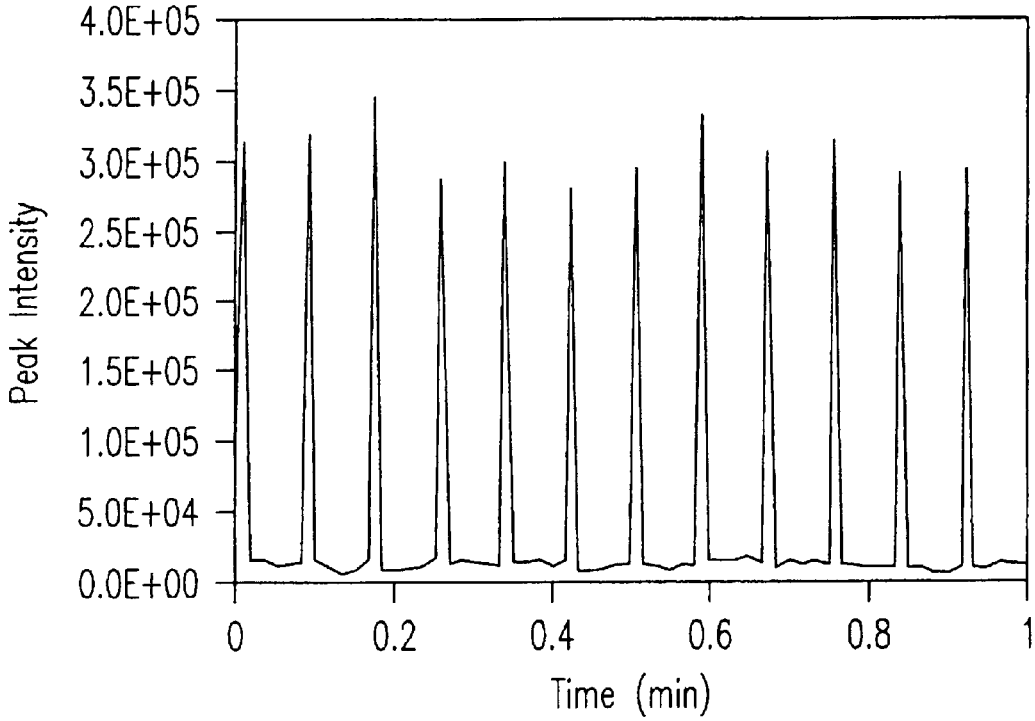
FIG. 7 is a graph showing the efficiency of dynamic ion transmission modulation through the jet disturber ion funnel channel: AC voltage on the jet disrupter, 0.2 Hz square waveform with voltage alternation of 100–156 V; duty cycle, 95% (250 ms high and 4.75 slow).

A square waveform voltage signal of different frequencies and duty cycles with adjustable DC offset is applied to the jet disturber. The reserpine sample solution was used for the jet disturber channel electrospray. Selected ion monitoring mode with an 0.8-amu scan window centered at reserpine ions and a 250-ms scan time were used for the MS operation. FIG. 7 shows the ion peak intensity variation for 1 min of data acquisition. The frequency of the square waveform is 0.2 Hz with 95% duty cycle, which results in a 250-ms open and 4.75-s closed time. The amplitude of the square wave is 56 Vp-p with a DC offset of 128 V, which results in a 156 V high and 100 V low potential variation on the jet disturber. The regularly spaced peaks, as shown in FIG. 7, clearly indicate that dynamic ion transmission modulation can be effectively achieved at very short time. Experimentally, it was observed that effective dynamic ion transmission modulation can be obtained even at a square waveform frequency of 0.8 Hz with 99% duty cycle, which results in a 12.5-ms open time. The data acquisition may become a problem at such high modulation speeds because of the limitations of the mass spectrometer scanning speed. Even at the scan speed of 250 ms, as shown in FIG. 7, the number of data points across each peak is significantly reduced. This may have resulted in the apparent broadening of the peak width. However, the present results confirm that the effective ion modulation is feasible at high speed.

The experimental investigation of the dual-channel ion funnel interface was further accompanied by theoretical studies. Ion trajectories in the jet disrupter channel of the ion funnel were simulated with a DC-only jet disturber positioned on the axis. The computer model was based upon theoretical approaches and algorithms developed previously for the simulation-based optimization of the ion funnel as described in Shaffer, S. A.; Tolmachev, A.; Prior, D. C.; Anderson, G. A.; Udseth, H. R.; Smith, R. D. *Anal. Chem.* 1999, 71, 2957–2964, Tolmachev, A. V.; Kim, T.; Udseth, H. R.; Smith, R. D.; Bailey, T. H.; Futrell, J. H. *Int. J. Mass Spec.* 2000, 203, 31–47 and Tolmachev, A. V.; Kim, T.; Masselon, C. D.; Rakov, S. V.; Pasa-Tolic, L.; Harkewicz, R.; Tang, K.; Udseth, H. R.; Smith, R. D Proceedings of the 49th ASMS Conference, Chicago, Ill., May 2001. The model allowed us to review various configurations of the device and obtain appreciation of its operation at different conditions, as given by RF frequency and amplitude, DC potentials, gas pressure, ion m/z, and gas flow configuration. The ion trajectory calculations take into account RF and DC electric fields and the bath gas influence. The original model described in Tolmachev, A. V.; Kim, T.; Udseth, H. R.; Smith, R. D.; Bailey, T. H.; Futrell, J. H. *Int. J. Mass Spec.* 2000 was modified to account for the ion funnel geometry changes as described below.

A 9-mm channel diameter was used for the jet disturber ion funnel channel. At the jet disturber position, two RF rings were replaced by a DC-only ring with the DC potential being equal to the jet disrupter potential. The jet disturber was simplified as a 2-mm-o.d. conductive disk positioned at the center of the channel. The gas flow was simplified as a superposition of the constant flow in the axial direction and a circular flow field satisfying the condition of the zero velocity at the jet disturber surface to account for the turbulence around the jet disturber. Divergent gas flows can also be predefined at the exit of the channel as shown in Tolmachev, A. V.; Kim, T.; Masselon, C. D.; Rakov, S. V.; Pasa-Tolic, L.; Harkewicz, R.; Tang, K.; Udseth, H. R.; Smith, R. D Proceedings of the 49th ASMS Conference, Chicago, Ill., May 2001.

As in previous ion funnel studies, it was found that the gas flows can be of significance for relatively high pressure and for ions with large cross section. Ion motion in the 1 Torr pressure range occurs in a transition region between vacuum type motion for distances <<1 mm and drift motion, where ions follow the direction of the field in the reference frame of the gas flow, which typically provides the dominant component. The model used was capable of realistically describing this behavior, including the random (i.e., diffusion) component of the ion motion, collision damping of the ion kinetic energy, effective focusing of ions in the RF fields, and ion motion in the DC fields.

Figure 8:
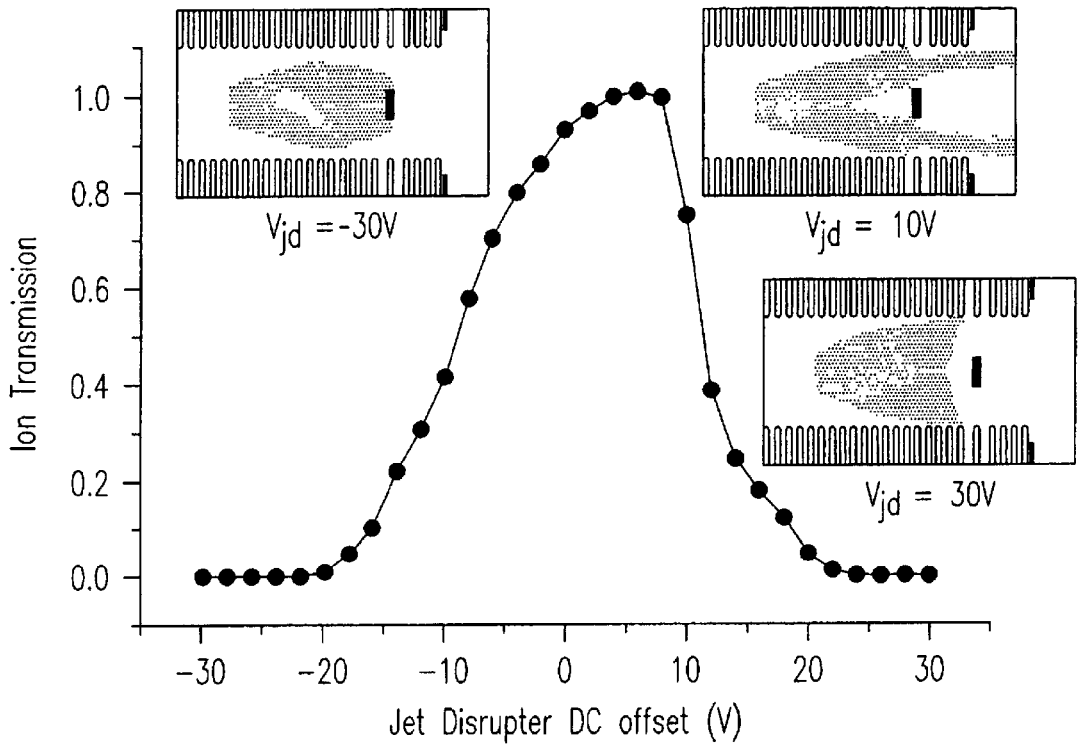
FIG. 8 is a graph showing ion transmission vs the jet disturber DC offset. Simulations for pressure 2 Torr, m/z= 1000 Da, ion with cross section 3E-14 $cm^2$, axial gas flow velocity of 50 m/s. Total ion current, 10 nA. The RF and DC parameters were the same as used in the experimental study: 500 kHz, 70 Vp-p, axial DC electric field 16.5 V/cm. The RF focusing rings of 9-mm i.d. are spaced 1 mm apart. Two middle RF rings (axial coordinate z=20 mm) were replaced by a DC-only ring electrically connected to the jet disturber. The inserts show screen copies of the ion trajectories at (a) $V_{jd}$=−30 V, (b) $V_{jd}$=10 V, and (c) $V_{jd}$=30 V.
Figure 9:
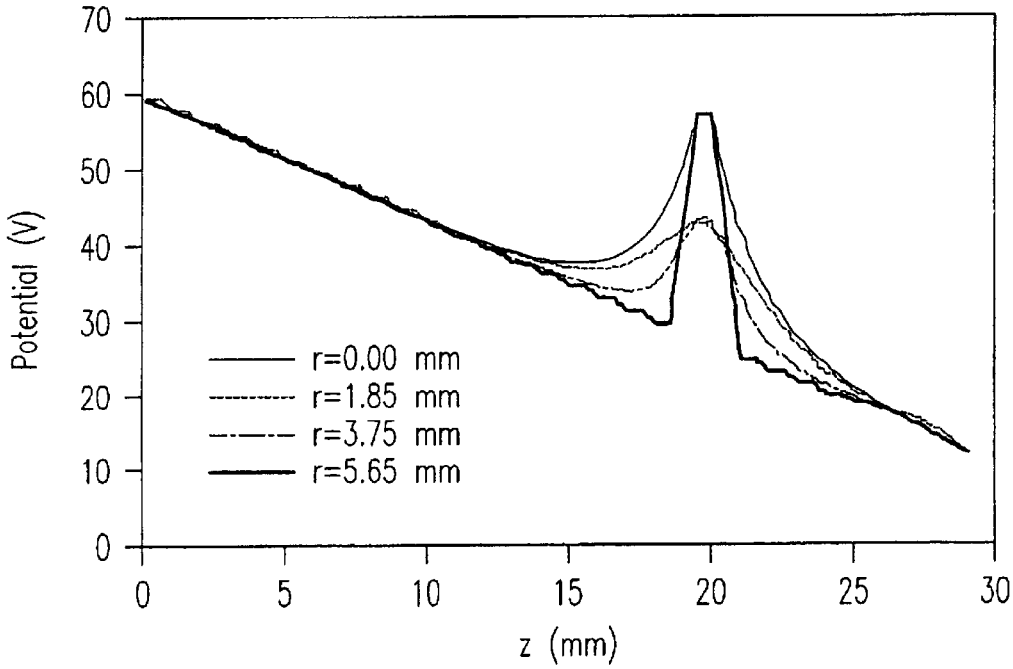
FIG. 9 is a graph showing DC potential distribution inside the RF focusing channel with the jet disturber. The jet disrupter DC offset is Vjd=30V. The axial profiles are shown for four different radii: 0, 1.85, 3.75, and 5.65 mm.

The simulated ion transmission curve, as shown in FIG. 8 for 10 nA total ion current, is qualitatively consistent with the experimental results, as shown in FIG. 6. Ion transmission in the ion funnel was suppressed when a sufficient DC offset, defined as the potential difference between the jet disturber and the neighboring ion funnel plate, was applied to the jet disturber (either positive or negative). At zero, or slightly positive DC offsets, the ion transmission reached a maximum. The ion trajectories (FIG. 8) also show the different operation modes for negative, optimal, and positive DC offsets. FIG. 8*a* shows ion trajectories for an offset $V_{jd}$=−30 V. All ions were attracted to the jet disturber plate and recombined on its surface. For zero or small positive DC offset, ions avoided the jet disturber, drifting at larger radii (FIG. 8*b*). Finally, for significantly large positive DC offsets, ions encountered a DC potential barrier and were forced to recombine on the neighboring RF ring electrodes (FIG. 8*c*). The DC potential profile corresponding to the latter case is further shown in the FIG. 9. The simulation in FIG. 9 clearly indicates that a DC potential barrier exists at any radial position at the jet disturber location, which explains the effective ion transmission modulation in the channel. It is also expected that a potential well will be developed near the jet disturber for the negative DC offset on the jet disturber, which is equally efficient for ion transmission modulation. These results show the experimentally observed behavior of the device is consistent with the physical concept outlined above and can be described reasonably well with the theoretical model. Both experimental evaluation and theoretical simulations show that the ion transmission efficiency for different m/z ions in the small diameter channel of the ion funnel can be effectively modulated by varying the bias voltage on the jet disturber. The optimum ion transmission voltage on the jet disturber is approximately equal to the DC potential on the neighboring regular ion funnel plate. Efficient ion transmission, similar to the standard single channel ion funnel, is maintained in the main channel of the ion funnel for a broad range of m/z ions (100–2500), whereas ion transmission in the jet disturber channel is effectively modulated. This indicates negligible "cross talk" of ion transmission between the two ion funnel channels. The approach ensures that both the spatial and the kinetic energy distributions for calibrant and analyte ions are identical, which is important for accurate mass measurements in Fourier transform ion cyclotron mass spectrometry. Both static and dynamic modulations of the ion transmission have been experimentally demonstrated by applying a constant voltage, either DC or AC, to the jet disturber. Consistent ion transmission behavior in the jet disturber channel of the ion funnel is obtained from both experiment and theoretical simulations. The dual channel interface developed through this study, when combined with FTICR, provides the basis to simultaneously achieve optimum sensitivity, dynamic range, and MMA which are essential for the analyses of complex biological samples relevant to high throughput proteomic research.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A multi-source ion funnel for introducing ions from a region at relatively high pressures to a region at relatively low pressures comprising:

a. at least two sets of primary elements having apertures, each set of elements having a receiving end and an emitting end, said first sets of elements configured to receive a ions from at least two separate ion sources at said receiving ends, and b. a secondary set of elements having elements having a receiving end and an emitting end, said secondary set of elements configured to receive said ions from the emitting end of said primary sets of elements, said primary elements and said secondary elements configured to have a voltage applied to said said primary elements and said secondary elements.

2. The multi-source ion funnel of claim 1, further comprising at least one jet disturber positioned within the interior of at least one of said sets of primary primary elements.

3. The multi-source ion funnel of claim 2, further comprising a means for providing a voltage in said jet disturber.

4. An apparatus for introducing ions into a mass spectrometer comprising:

a. at least two electrospray ion sources, b. at least two capillary inlets, and c. the mutli-source ion funnel of claim 1, wherein each of said electrospray ion sources is configured to direct ions generated by said electrospray sources into and through each of said capillary inlets, and said capillary inlets are further configured to direct said ions into the receiving end of said sets of primary elements.

5. The apparatus of claim 4 further comprising at least one jet disturber positioned within at least one of said sets of primary elements.

6. The apparatus of claim 4, further comprising a means for providing a voltage in said jet disturber.

7. A method for introducing ions into a mass spectrometer comprising:

a. providing at least two electrospray ion sources, b. providing at least two capillary inlets configured to direct ions generated by said electrospray sources into and through each of said capillary inlets, c. providing at least two sets of primary elements having apertures, each set of elements having a receiving end and an emitting end, said primary sets of elements configured to receive a ions from said capillary inlets at said receiving ends, and d. providing a secondary set of elements having apertures having a receiving end and an emitting end, said secondary set of elements configured to receive said ions from the emitting end of said primary sets of elements and emit said ions from said emitting end of said secondary set of elements, said primary elements and said secondary elements configured to have a voltage applied to said primary elements and said secondary elements.

8. The method of claim 7 further comprising the step of providing at least one jet disturber positioned within at least one of said sets of primary elements.

9. The method of claim 8, further comprising the step of providing a voltage in said jet disturber, thereby adjusting the transmission of ions through at least one of said sets of primary elements.

10. The method of claim 9 wherein the voltage provided in said jet disturber is a dc voltage.

11. The method of claim 9, wherein the step of adjusting the transmission of ions through at least one of said sets of primary elements prevents the transmission of ions through at least one of said sets of primary elements.

12. The method of claim 9 wherein the applied voltage is applied intermittently, thereby providing intermittent disruption of the ions through at least one of said sets of primary elements.

13. The method of claim 10 wherein the applied voltage is applied intermittently as a square wave form, thereby providing intermittent disruption of the ions through at least one of said sets of primary elements.

14. The method of claim 8 wherein a jet disturber is provided within each of at least two of said primary elements.

15. The method of claim 14, further comprising the step of providing a voltage in said jet disturbers, thereby adjusting the transmission of ions through at least two of said sets of primary elements.

16. The method of claim 15 wherein the voltage provided in said jet disturbers is a dc voltage.

17. The method of claim 15, wherein the step of adjusting the transmission of ions through at least two of said sets of primary elements prevents the transmission of ions through at least two of said sets of primary elements.

18. The method of claim 15 wherein the applied voltage is applied intermittently, thereby providing intermittent disruption of the ions through at least two of said sets of primary elements.

19. The method of claim 18 wherein the applied voltage is applied intermittently as a square wave form, thereby providing intermittent disruption of the ions through at least two of said sets of primary elements.

20. The method of claim 18 wherein the voltage applied intermittently is alternated between the jet disturbers, thereby alternating the disruption of the transmission of ions through at least two of said sets of primary elements.

21. A method for introducing calibrant ions and analyte ions into a mass spectrometer comprising:

a. providing two electrospray ion sources, one for providing calibrant ions, and the other for providing analyte ions, b. providing two capillary inlets configured to direct ions generated by said electrospray sources into and through each of said capillary inlets, c. providing two sets of primary elements having apertures, each set of elements having a receiving end and an emitting end, one of said primary sets of elements configured to receive a ions from said capillary inlets at said receiving ends, and d. providing a secondary set of elements having apertures and having a receiving end and an emitting end, said secondary set of elements configured to receive said ions from the emitting end of said primary sets of elements and emit said ions from said emitting end of said secondary set of elements, said primary elements and said secondary elements configured to have a voltage applied to said said primary elements and said secondary elements.

22. The method of claim 21 further comprising the step of providing at least one jet disturber positioned within at least one of said sets of primary elements.

23. The method of claim 22, further comprising the step of providing a voltage in said jet disturber, thereby adjusting the transmission of ions through at least one of said sets of primary elements.

24. The method of claim 23 wherein the voltage provided in said jet disturber is a dc voltage.

25. The method of claim 23, wherein the step of adjusting the transmission of ions through at least one of said sets of primary elements prevents the transmission of ions through at least one of said sets of primary elements.

26. The method of claim 23 wherein the applied voltage is applied intermittently, thereby providing intermittent disruption of the transmission of ions through at least one of said sets of primary elements.

27. The method of claim 26 wherein the applied voltage is applied intermittently as a square wave form, thereby providing intermittent disruption of the transmission of ions through at least one of said sets of primary elements.

28. The method of claim 21 wherein a jet disturber is provided within each of said two sets of primary elements.

29. The method of claim 28, further comprising the step of providing a voltage in said jet disturbers, thereby adjusting the transmission of ions through said two sets of primary elements.

30. The method of claim 29 wherein the voltage provided in said jet disturbers is a dc voltage.

31. The method of claim 29, wherein the step of adjusting the transmission of ions through said two sets of primary elements prevents the transmission of ions through said two sets of primary elements.

32. The method of claim 29 wherein the applied voltage is applied intermittently, thereby providing intermittent disruption of the transmission of ions through said two sets of primary elements.

33. The method of claim 32 wherein the applied voltage is applied as a square wave form, thereby providing intermittent disruption of the ions through said two sets of primary elements.

34. The method of claim 32 wherein the voltage applied intermittently is alternated between the jet disturbers, thereby alternating the disruption of the transmission of calibrant ions and analyte ions through said sets of primary elements.

* * * * *